US007148804B2

(12) United States Patent
Salesky et al.

(10) Patent No.: US 7,148,804 B2
(45) Date of Patent: Dec. 12, 2006

(54) SYSTEM AND METHOD FOR DETECTING EAS/RFID TAGS USING STEP LISTEN

(75) Inventors: Ronald Salesky, Tabernacle, NJ (US); John Paranzino, Sewell, NJ (US); Nimesh Shah, Marlton, NJ (US)

(73) Assignee: Checkpoint Systems, Inc., Thorofare, NJ (US)

( * ) Notice: Subject to any disclaimer, the term of this patent is extended or adjusted under 35 U.S.C. 154(b) by 191 days.

(21) Appl. No.: 11/043,501

(22) Filed: Jan. 26, 2005

(65) Prior Publication Data

US 2006/0097874 A1 May 11, 2006

Related U.S. Application Data

(60) Provisional application No. 60/626,063, filed on Nov. 8, 2004.

(51) Int. Cl.
*G08B 13/14* (2006.01)

(52) U.S. Cl. ..... 340/572.4; 340/572.1; 340/572.2; 340/568.1

(58) Field of Classification Search ..... 340/572.1, 340/572.2, 572.4, 572.7, 568.1, 10.1, 10.3, 340/10.4, 10.41, 10.51, 10.52; 342/429, 342/445; 455/108
See application file for complete search history.

(56) References Cited

U.S. PATENT DOCUMENTS

| | | | | |
|---|---|---|---|---|
| 3,707,711 | A * | 12/1972 | Cole et al. | 340/10.34 |
| 5,859,587 | A | 1/1999 | Alicot et al. | |
| 6,232,878 | B1 | 5/2001 | Rubin | |
| 6,249,229 | B1 | 6/2001 | Eckstein et al. | |
| 6,271,756 | B1 | 8/2001 | Davies, Jr. et al. | |
| 6,356,197 | B1 | 3/2002 | Patterson et al. | |
| 6,359,562 | B1 | 3/2002 | Rubin | |
| 6,362,738 | B1 * | 3/2002 | Vega | 340/572.1 |
| 6,737,973 | B1 * | 5/2004 | Jesme | 340/572.1 |
| 6,894,614 | B1 * | 5/2005 | Eckstein et al. | 340/572.1 |

OTHER PUBLICATIONS

International Search Report dated Feb. 28, 2006 for corresponding PCT/US2005/040247.

* cited by examiner

*Primary Examiner*—Van T. Trieu
(74) *Attorney, Agent, or Firm*—Caesar, Rivise, Bernstein, Cohen & Pokotilow, Ltd.

(57) ABSTRACT

A system and method for the real-time concurrent detection of 13.56 MHz RFID and 8.2 MHz EAS identification tags using a single stimulus signal.

43 Claims, 13 Drawing Sheets

FIG.2
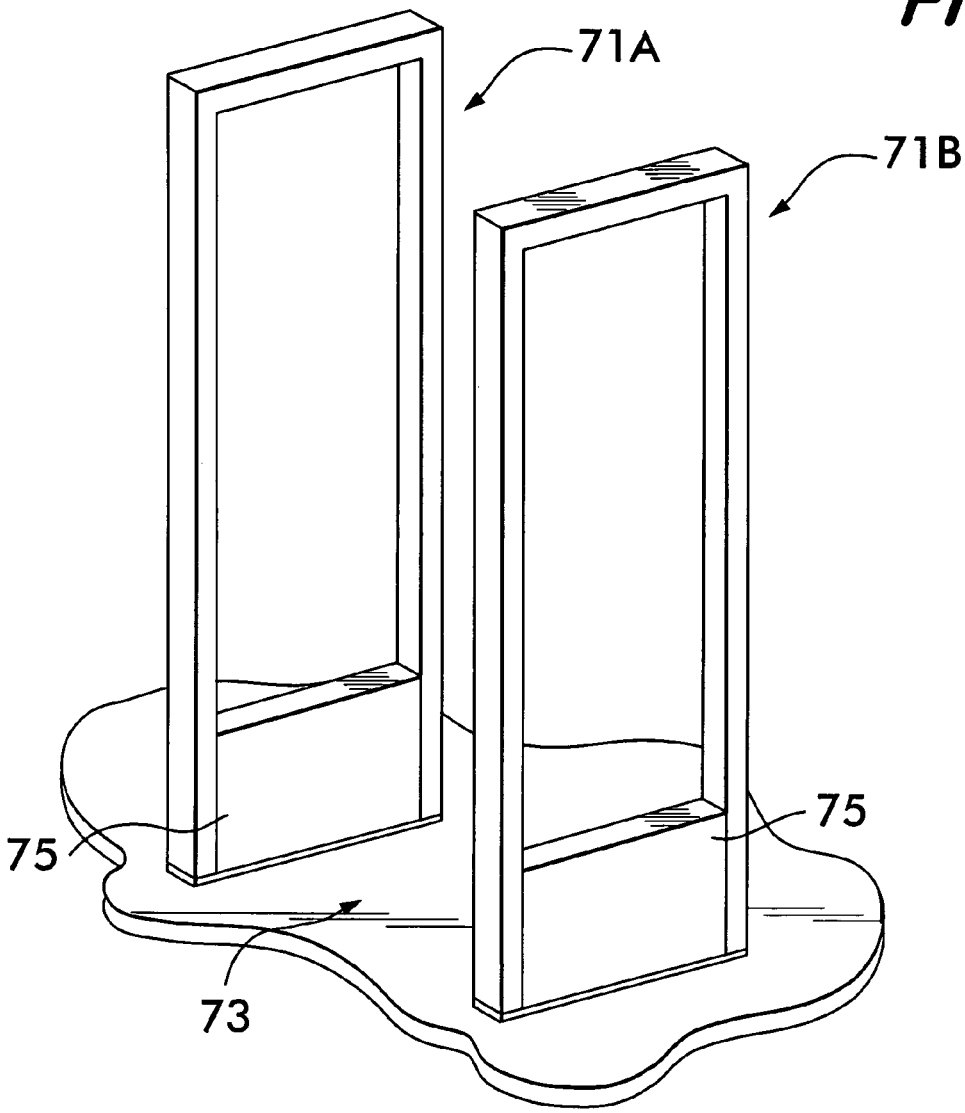
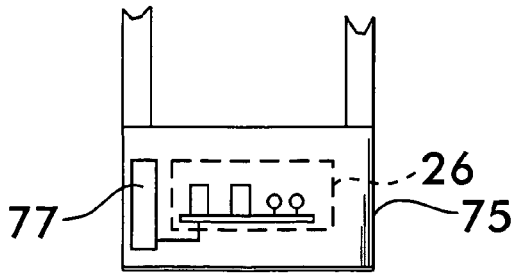
FIG.3

Serial Communications Cable
PC
Power Supplies Not Shown
13
Transmitter Output 50 ohm
22
ISO15693 Modulation (Synchronization)
O'scope
RFID Reader
Function Generator
O'scope Trigger
24
EAS Step-Listen Receiver
Step-Listen Analog Receiver Signals (I&Q)
External Local oscillator (Gated)
20
30
New Impedance Match Network
28

30
23A
DEACTIVATED EAS TRANSMITTER
BPF
RF Amplifier
BPF
14
RF Amplifier
DDS
-8.2MHZ
From DSP
24
EAS STEP-LISTEN RECEIVER
BPF
13.56 MHZ
Band-Stop
Filter
Limiter
RF Amplifier
BPF
RF Amplifier
Function Generator
8.2MHZ
LPF
ADC FIG.11
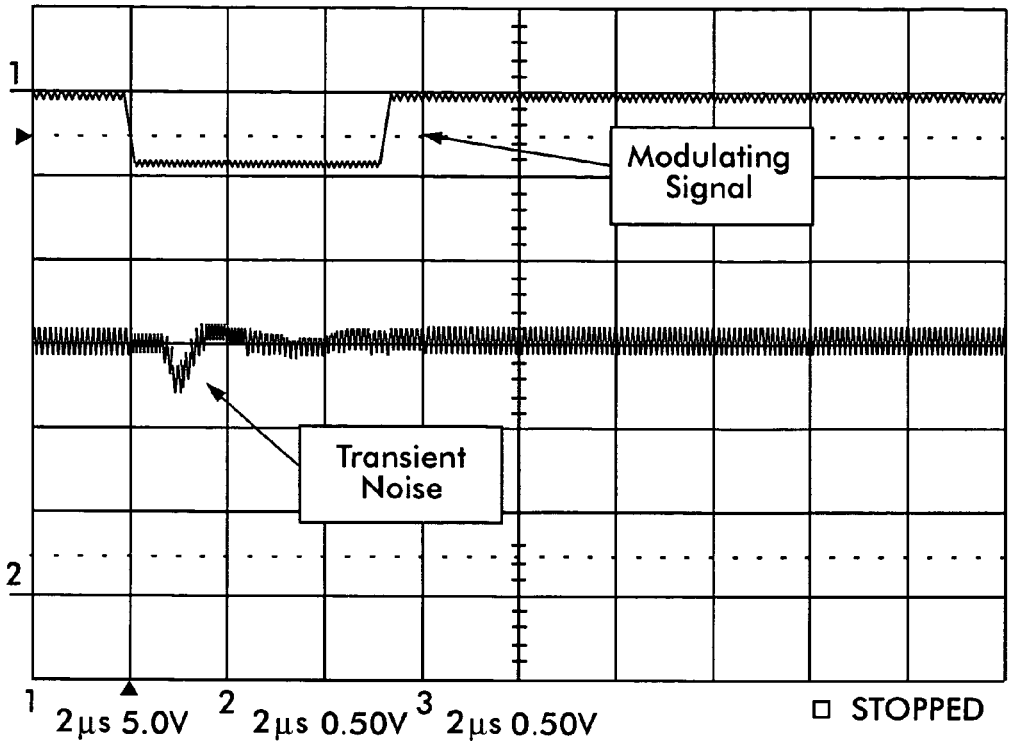
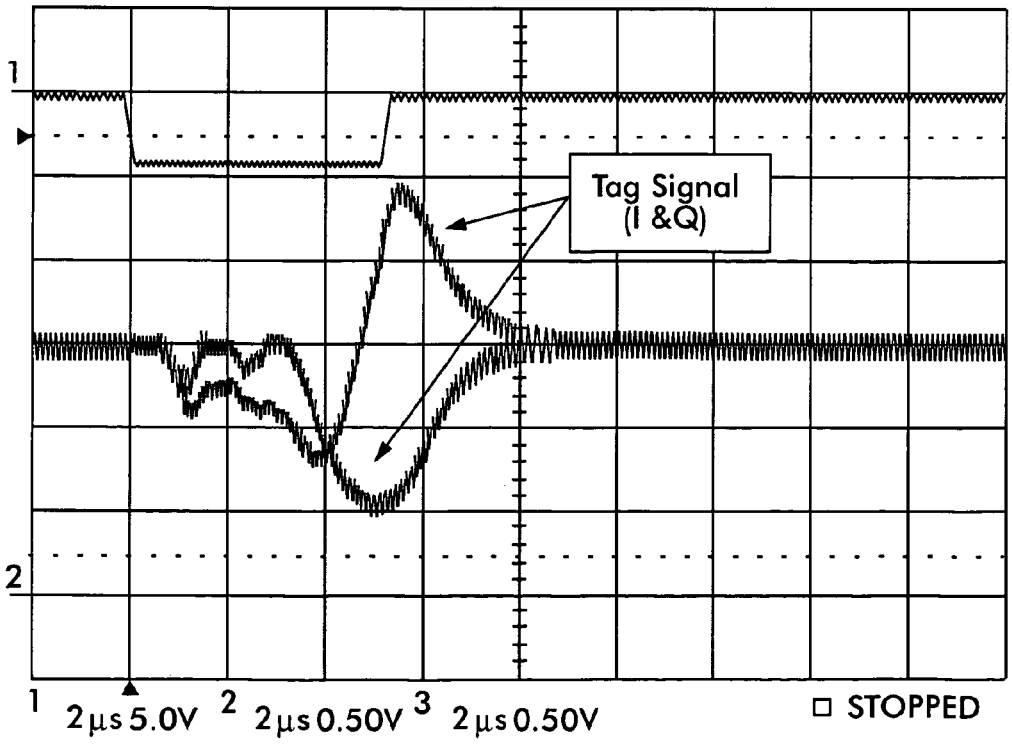
FIG.12

FIG.13
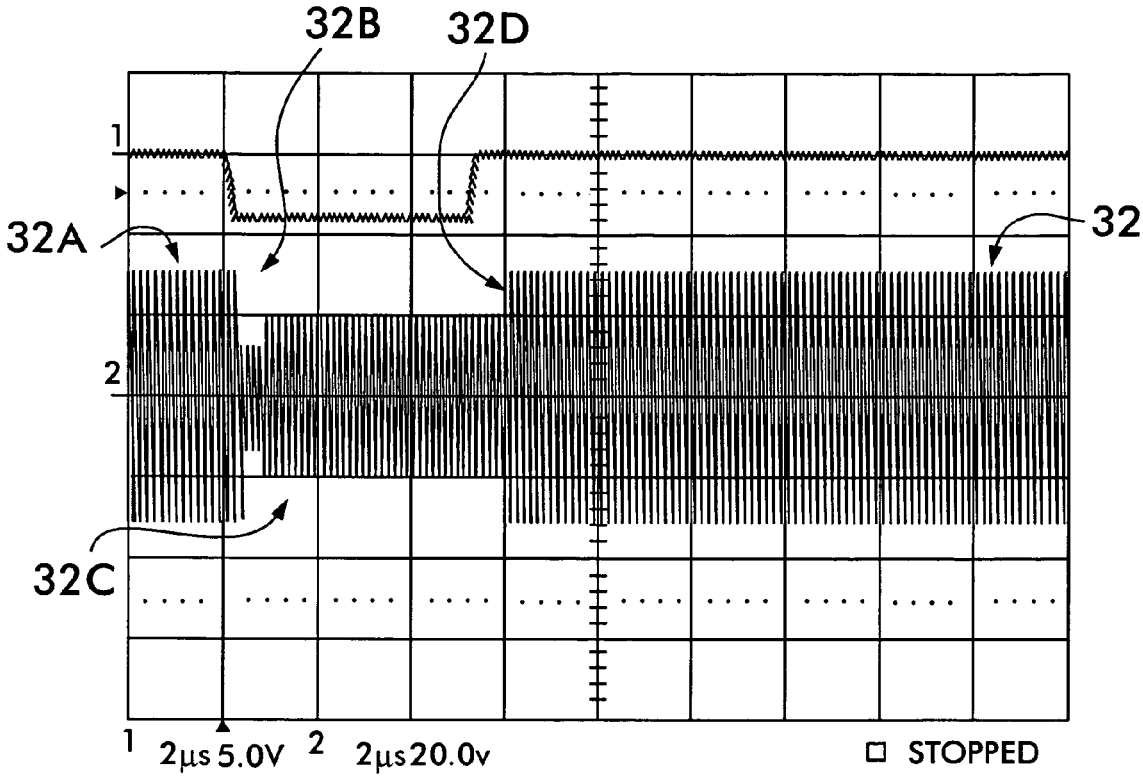
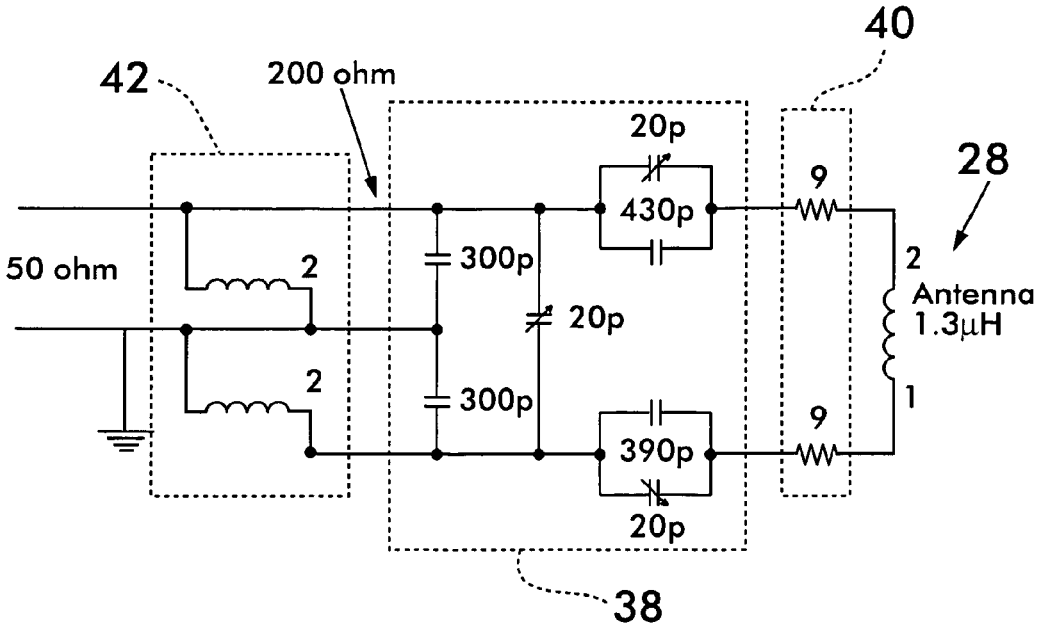
FIG.14

FIG.15
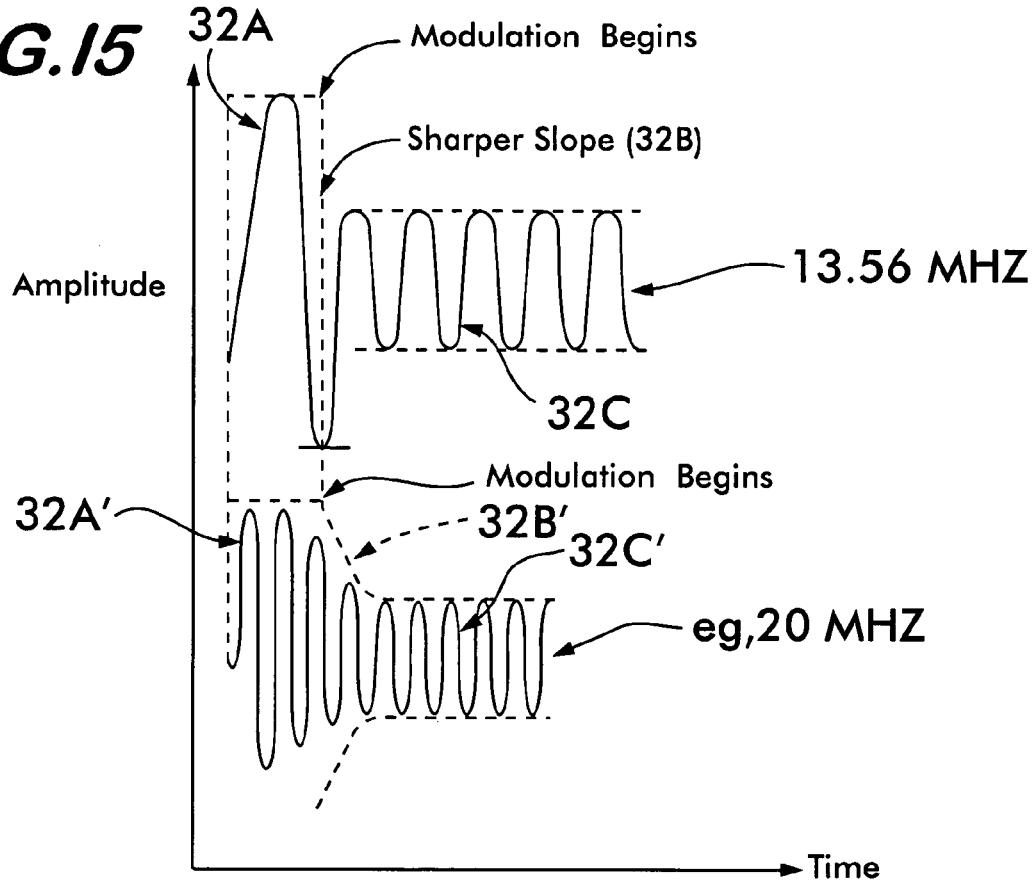
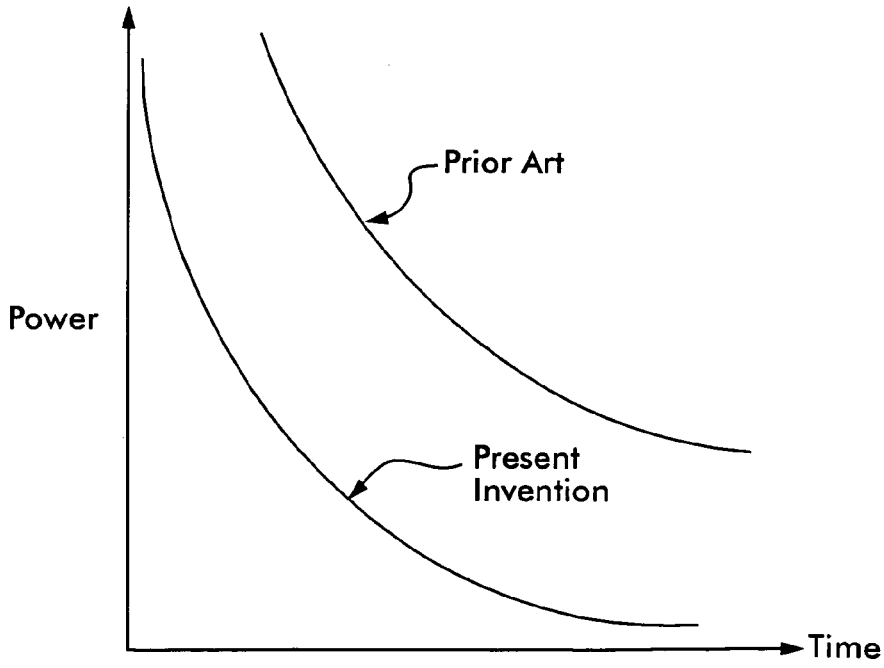
FIG.16

SYSTEM AND METHOD FOR DETECTING EAS/RFID TAGS USING STEP LISTEN

CROSS-REFERENCE TO RELATED APPLICATIONS

This utility application claims the benefit under 35 U.S.C. §119(e) of Provisional Application Ser. No. 60/626,063 filed on Nov. 8, 2004 entitled SYSTEM AND METHOD FOR DETECTING EAS/RFID TAGS USING STEP LISTEN and whose entire disclosure is incorporated by reference herein.

BACKGROUND OF THE INVENTION

1. Field of Invention

This invention relates generally to identification tags and, more particularly, to a system and method for the simultaneous detection of 8.2 MHz EAS tags and 13.56 MHz ISO15693 RFID Tags.

2. Description of Related Art

The use of EAS (electronic article surveillance) tags and RFID (radio frequency identification) tags for a wide variety of read, track and/or detect applications is rapidly expanding. A smooth bridge between existing EAS and RFID functionality has been a consistent theme identified by users interested in RFID to allow them to obtain the benefits of RFID while maintaining their investment in EAS technology and its usefulness in protecting lower cost objects for sale that cannot justify the higher implementation cost of RFID. However, where identification tags are capable of receiving both EAS and RFID frequencies, the conventional manner in which the respective EAS or RFID signals return from these tags is processed exhibits certain shortcomings or limitations. For example, the reader for these signals comprises an 8.2 MHz EAS transceiver and a 13.56 MHz RFID transceiver in the same package that drive separate antennae. The interference between the two technologies is handled by traditional analog signal filtering techniques. Utilizing such a configuration, though, involves: redundancy of components (i.e., duplication of transceiver components, duplication of antennae, etc.); the degree of filtering required is great (estimated at 100 dB) due to the very close proximity in frequency (less than 1 octave) and the relative signal amplitude differences allowable for the 2 transmission bands; the need for 2 antennae results in a much wider structure (roughly double) than for either technology deployed alone; and even with these techniques, performance is inferior than for either technology deployed alone.

Although "pulse-listen" methodologies (e.g., transmitting a sequence of RF burst signals at different frequencies so that at least one of the frequencies bursts falls near a resonant frequency of the identification tag) are related to the present invention, e.g., U.S. Pat. No. 6,249,229 (Eckstein, et al.), which is incorporated by reference herein, one of the disadvantages of these is that when RFID tags are used, there must be a continuous signal emission from the reader to power the RFID chip.

Communication with RFID tags can include two modes of operation: "tag talk first" (TTF) or "reader talk first" (RTF). In TTF mode, the tag transmits its information upon receipt of the reader's signal. In contrast, in RTF mode, the reader emits commands to the tag (to avoid collisions) and the tag emits responses to those commands. Thus, RTF is the more complex of the two modes and it is RTF operation to which the present invention pertains.

Thus, there remains a need for a system and method that can simultaneously detect EAS and RFID identification tag signals while avoiding the shortcomings discussed previously.

BRIEF SUMMARY OF THE INVENTION

The RFID "reader talk-first" (RTF) concept of the present invention requires amplitude modulation of the 13.56 MHz carrier for communicating commands to the RFID tag. This modulation takes the form of a 10% modulation index gap in the carrier for such leading RFID technologies as ISO15693 or EPC (Electronic Product Code). The modulation index, m, is defined as:

$$m = \frac{(V_{max} - V_{min})}{(V_{max} + V_{min})}$$

and it is a measure of the drop in amplitude vs. the steady-state amplitude of the R-T (reader-to-tag) signal; the timing of these drops is the method of R-T communication. The ISO15693 standard specifies two choices for m, i.e., m=10% or m=100% (in particular, the ISO15693 standard specifies that the tag must be operational with a reader modulation index of 10–30%, or 100%). Most reader and tag manufacturers use m=10%.

The carrier envelope edge formed during this modulation causes a transient response in any LC resonant circuits in the magnetic field of the system due to the excess stored energy in those tags being dissipated as the carrier forcing function amplitude is reduced. Detection of this stored energy transient (also referred to as the "natural response") is the essence of RF/EAS detection as deployed in the Assignee's (namely, Checkpoint Systems, Inc.) pulse-listen system, as an example. By using this inherent physical characteristic associated with RFID tag signaling, EAS functionality may be included as a natural inherent aspect of the system. Furthermore, the present invention allows common usage of the majority of the transceiver sections avoiding cost and space inefficiencies in duplication of circuitry as well as a shared antenna structure.

The system and method of step-listen of the present invention provides advantages in tag throughput, detection performance of both technologies and in manufacturing costs.

As will be discussed in detail later, the system and method concurrently detect EAS and 13.56 MHz HF (high frequency) RFID tags. The RFID technology suggested, by way of example, is ISO15693 compliant, as well as the usage of custom codes that are specific to the SLI chip.

RFID command synchronization has been correctly identified as a major performance constriction at the security gate. There are two levels of synchronization that need to be maintained: RF carrier synchronization at the security gate and AM (amplitude modulation) command synchronization between all security gates. The need for AM command synchronization has far reaching performance implications. The RFID tags undergo processing at the POS (point-of-sale) whose interface can be handled by lower power levels, antenna directionality to minimize coupling and shielding around the POS antenna so they can operate autonomously. The security gates however see activity at other security gates throughout the store. This requires that reader command modulation be synchronized amongst the security gates. A complicating factor of command synchronization is the fact that ISO15693 places the responsibility for collision detection and resolution on the part of the reader. This means that if it is desired that all RFID tag collisions be resolved at all security gates, all security gates must be able to communicate the presence of collisions to the central synchronization source, which would then direct all readers to issue new commands to resolve the collision, regardless of whether the collision occurred within a non-deterministic throughput at the security gates dependent upon the probabilities of collision within a gate, the number of gates and the number of resolution steps required. It is assumed that the tag density at any given security gate is considerably less than 16 at any given time.

There are two approaches to create the synchronization link. One is by physically wiring all the security gates together. The second is to utilize the very effect that requires the synchronization. Thus, a wireless synchronization system transmits the command modulation on a 13.56 MHz carrier as usual. All other security gates in the system seek the command modulation edge and establish phase lock to it and retransmit the signal at their respective location. A similar synchronization method is employed for the 13.56 MHz RF carrier within each security gate.

As mentioned earlier, the simultaneous real-time concurrent detection of 13.56 MHz RFID and 8.2 MHz EAS is a challenge due to the relative proximity (less than an octave) of the two frequencies to each other. Bandpass filtering techniques are problematic particularly for the 8.2 MHz EAS part because of the inverse relationship between time-domain and frequency-domain, i.e., the sharper the filter in the frequency domain, the longer its transient response in the time domain. Since detection of the EAS tags is inherently a time-domain process, simply putting the two systems together running simultaneously is not a good option. There are to approaches to resolving this, the one being more technically challenging than the other.

BRIEF DESCRIPTION OF SEVERAL VIEWS OF THE DRAWINGS

The invention will be described in conjunction with the following drawings in which like reference numerals designate like elements and wherein:

FIG. 2 is an isometric view of exemplary pedestals used with the present invention;

FIG. 3 is one of the bases of one of the pedestals, shown in portion depicting where the electronics of the present invention is preferably installed therein;

FIG. 11 depicts oscilloscope traces of an EAS receiver baseband where no EAS tag is present;

FIG. 12 depicts oscilloscope traces of the EAS receiver baseband where an EAS tag is present;

FIG. 13 depicts a lower Q antenna waveform showing sharp modulation edges;

FIG. 14 is a lower Q antenna and impedance match network schematic of the RFID reader;

FIG. 15 is amplitude vs. time diagram of the preferred carrier frequency and a less preferred carrier frequency for achieving a sharp transition during modulation;

FIG. 16 is a power vs. time plot of carrier signal as modulation occurs comparing the power reduction in the present invention which forms the sharp falling transition against the power reduction in other RFID readers using modulation.

DETAILED DESCRIPTION OF THE INVENTION

Figure 1:
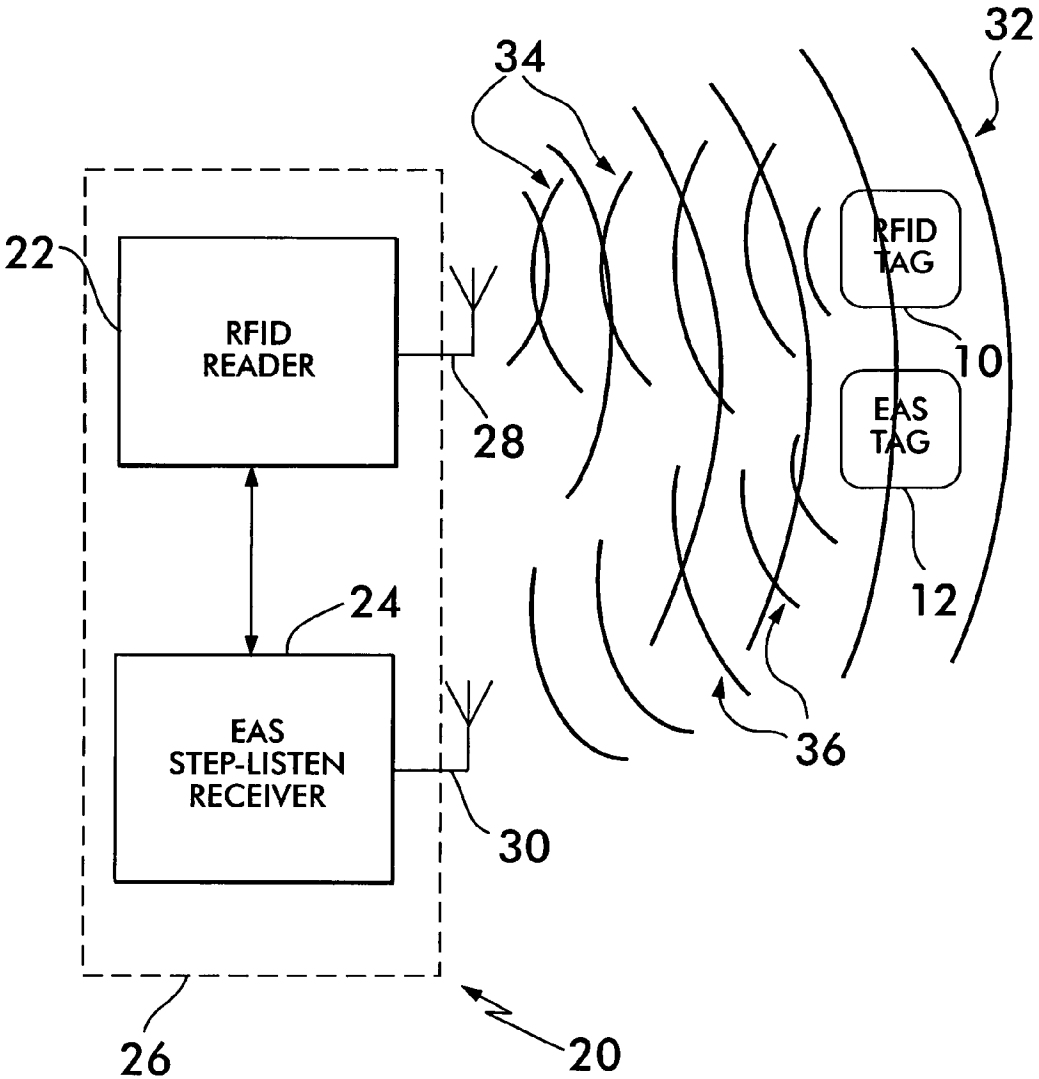
FIG. 1 is a block diagram of the present invention.
Figure 4:
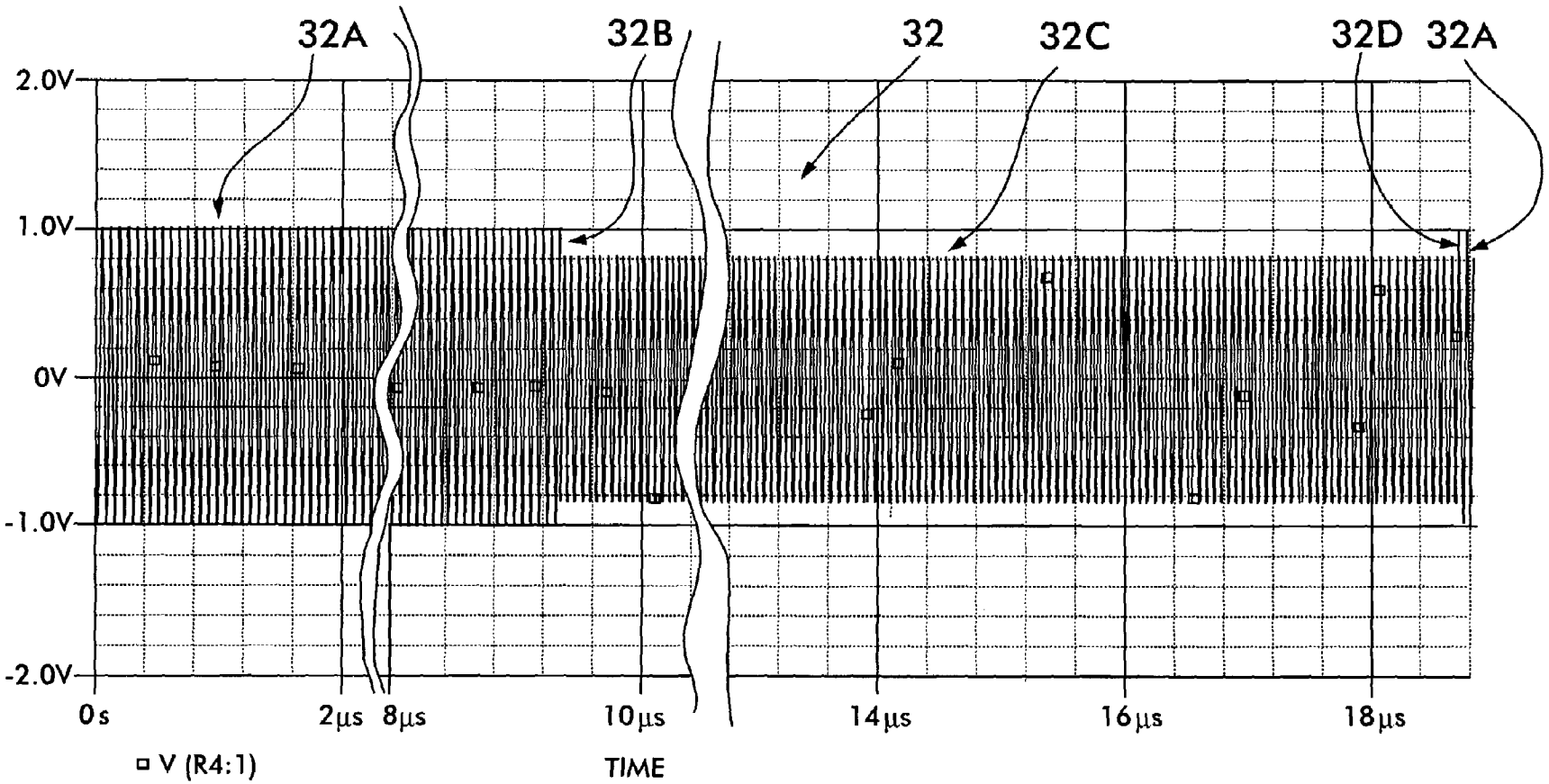
FIG. 4 depicts a typical RFID reader RTF stimulus signal (e.g., 13.56 MHz carrier)
Figure 5:
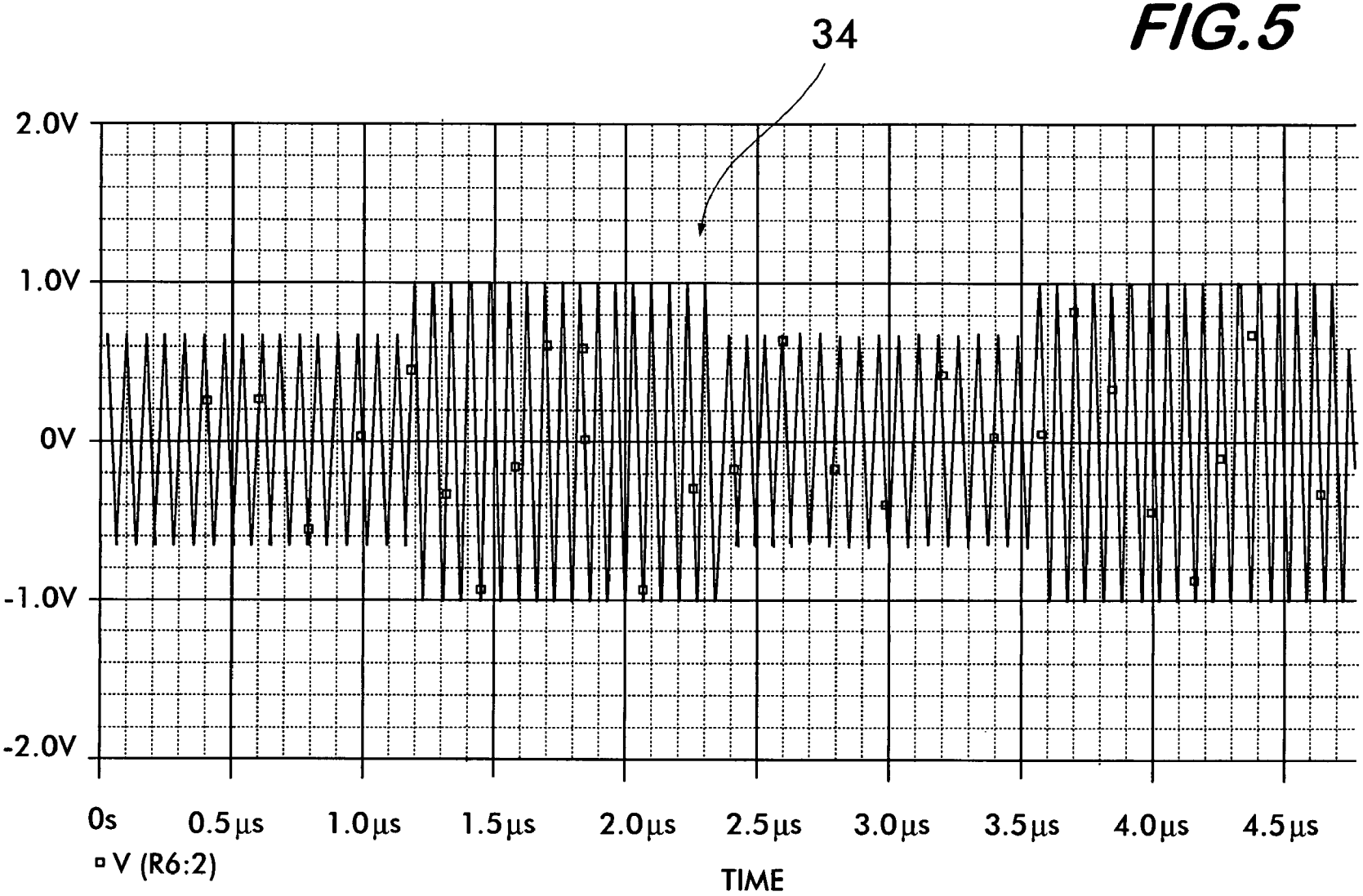
FIG. 5 depicts an RFID tag signal (e.g., 13.56 MHz carrier) in response to the RTF stimulus signal.
Figure 6:
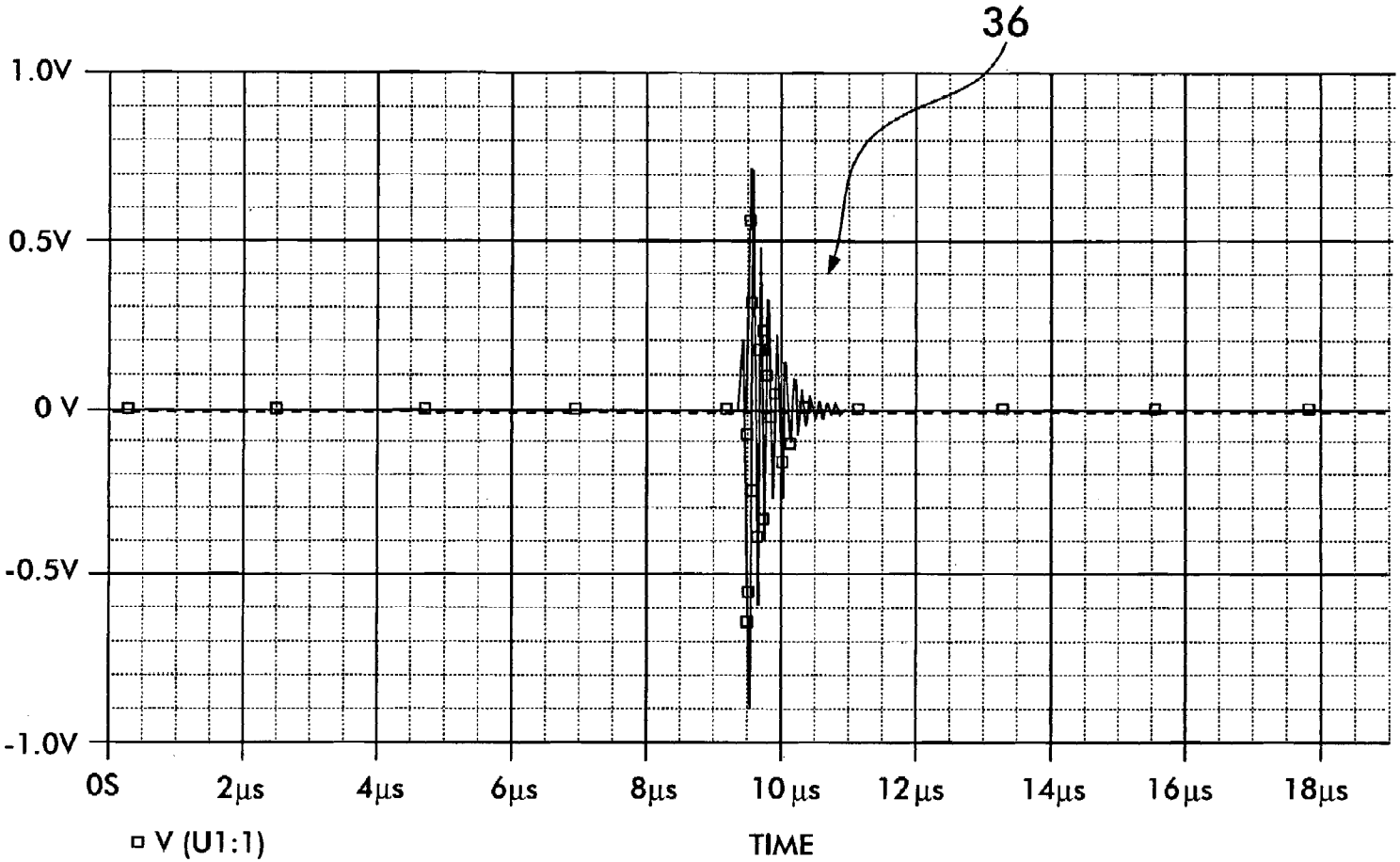
FIG. 6 depicts an EAS natural response "ring-down" signal (e.g., 8.2 MHz) in response to the RTF stimulus signal.

The present invention 20, as shown in FIG. 1, basically comprises an RFID reader 22 and an EAS step-listen receiver 24 that may be positioned in a single housing 26, and each having respective antennae 28 and 30. In operation, the RFID reader 22 emits the stimulus 32 (FIG. 4) which includes an RFID carrier frequency (e.g., 13.56 MHz), modulated with RTF commands. If an RFID tag 10 is present and is tuned to that RFID frequency, the RFID tag 10 emits a response 34 (FIG. 5) that is detected by the RFID reader 22. If an EAS tag 12 is also present in the vicinity and which is tuned to an EAS frequency (e.g., 8.2 MHz), the EAS tag 12 emits (FIG. 6) a natural response "ring down" signal 36 (caused by the stimulus 32) which is detected by the EAS step-listen receiver 24. It should be understood that the stimulus 32 and the "ring-down" signal 36 are nearly concurrent in time whereas the RFID response 34 occurs later in time.

FIG. 2 depicts an exemplary pair of security pedestals 71A/71B (e.g., Checkpoint Strata™ PX pedestals, etc.) at the entrance/exit of a business 73. The single housing 26 of the present invention 20 may be disposed in one of the two pedestals 71A/71B, typically at the base 75, as shown in FIG. 3. An internal power supply 77 provides power to the RFID reader 22 and EAS step-listen receiver 24 and other related electronics. It should be understood that it is within the broadest scope of the present invention to also include the RFID reader 22 and the EAS step-listen receiver 24 in respective pedestals 71A and 71B.

Figure 7:
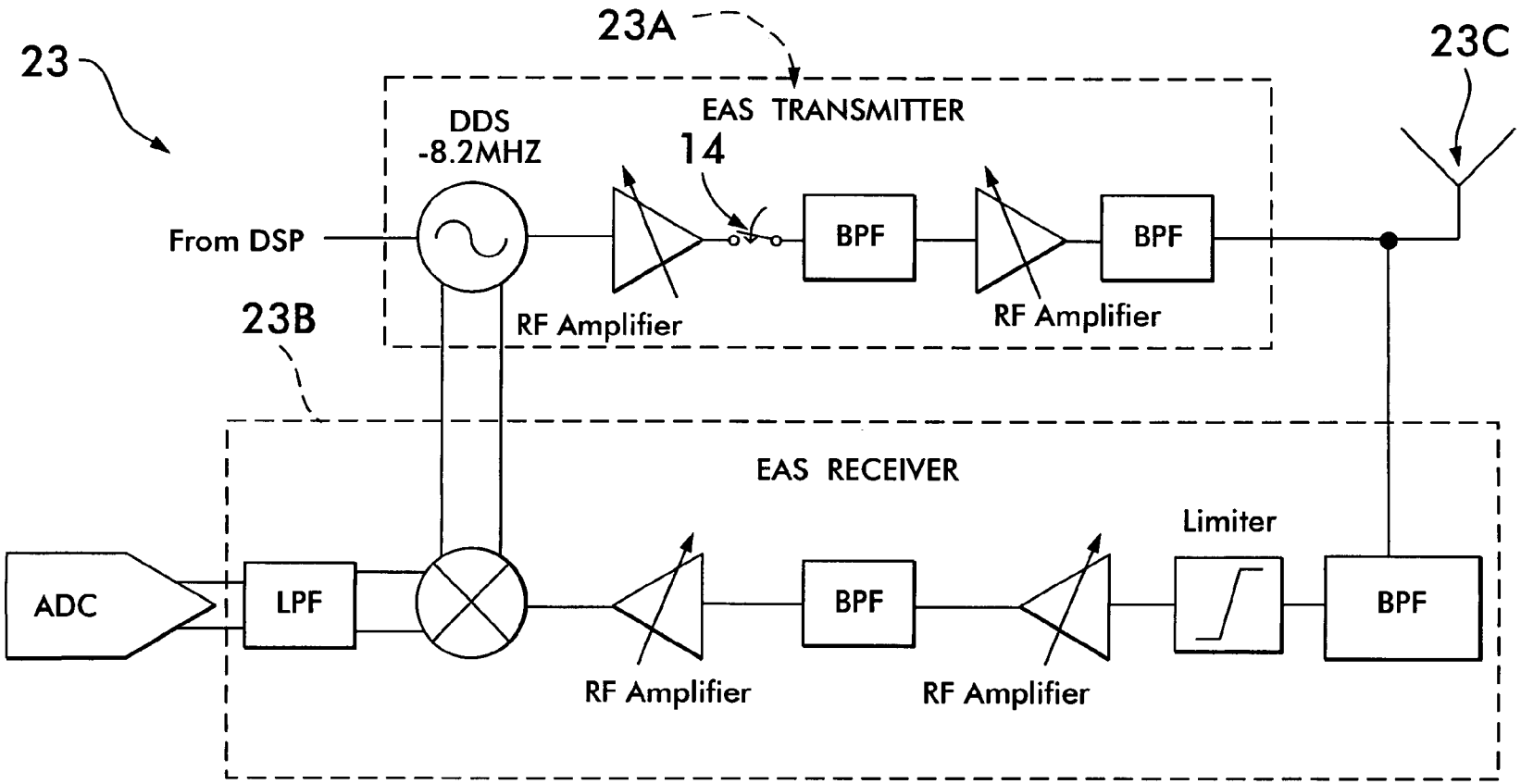
FIG. 7 is a block diagram of a generic EAS pulse-listen transceiver.
Figure 8:
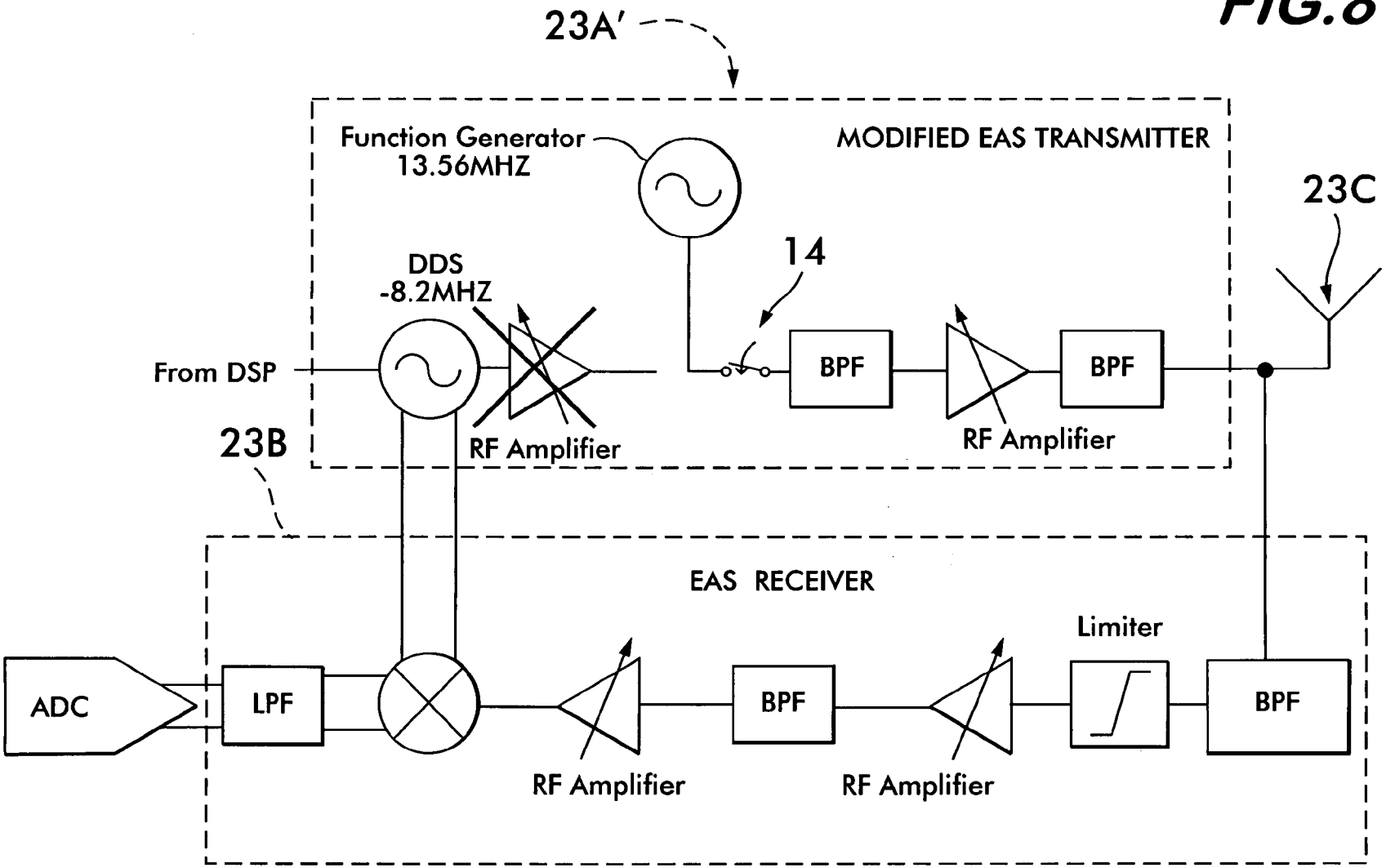
FIG. 8 is a block diagram of the modified transmitter portion of a generic EAS pulse-listen transceiver for 13.56 MHz operation during the conceptual part testing.

The system of the present invention 20 described provides an exemplary working embodiment of a system and method for the simultaneous real-time concurrent detection of 13.56 MHz RFID and 8.2 MHz EAS identification tags using the step-listen methodology. The ISO15693 RFID protocol (as will be explained later) was used in this working embodiment. The working embodiment involved testing in two parts:

(1) a conceptual part using only an EAS pulse-listen system (also referred to as an EAS transceiver 23 having an EAS transmitter 23A, an EAS receiver 23B and a pulse-listen antenna 23C, as shown in FIG. 7), e.g., Checkpoint's TR4024 pulse-listen device, but whose EAS transmitter 23A' is modified to transmit at 13.56 MHz (see FIG. 8 where an RF amplifier connected to a direct digital 8.2 MHz synthesizer (DDS) is disabled (indicated by the "X" indicia in FIG. 8) and an external 13.56 MHz signal generator feeds a bandpass filter (BPF) in the modified EAS transmitter 23A'). A Checkpoint EAS #410 test tag 12 was used as the target.

Figure 9:
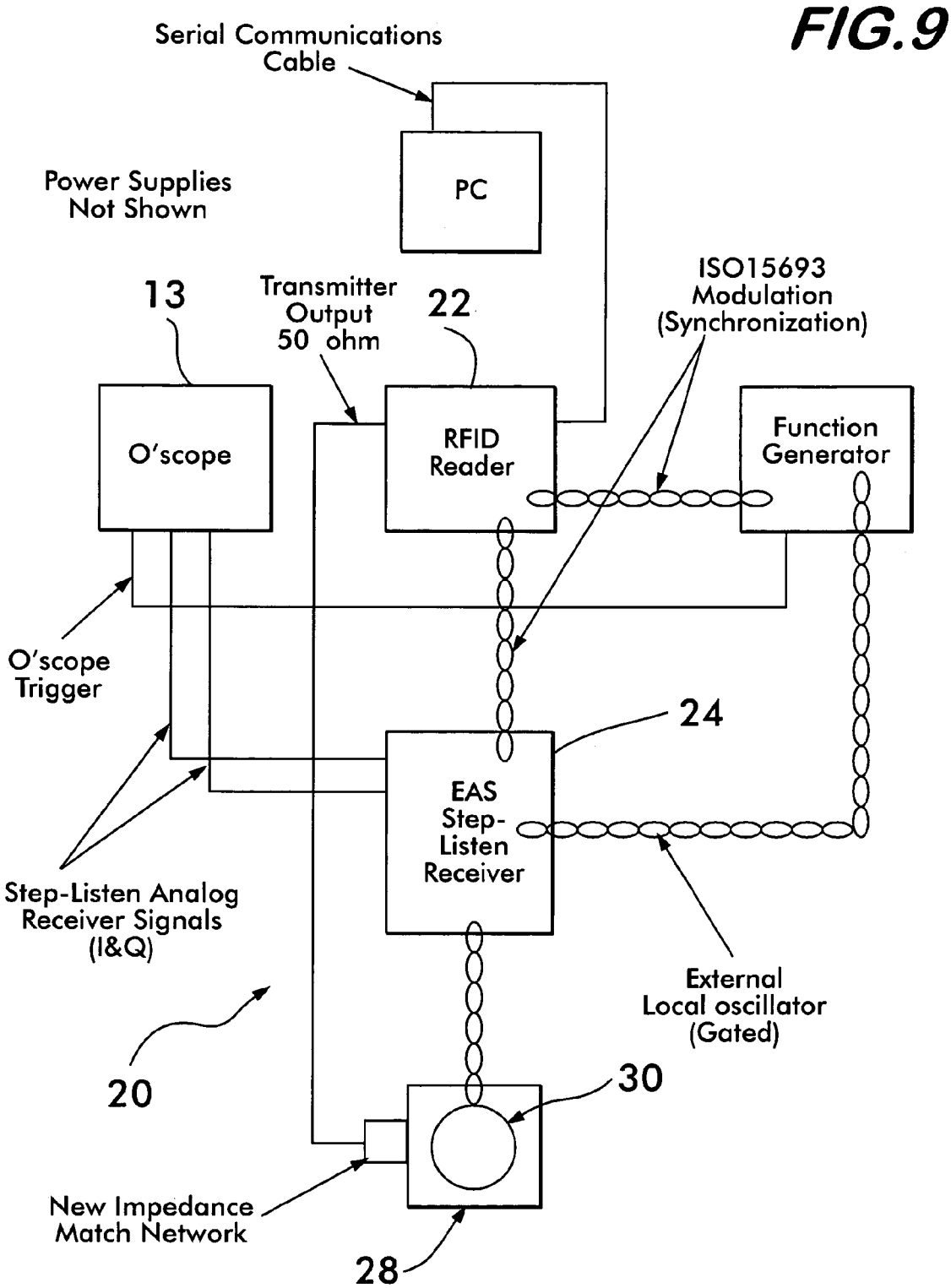
FIG. 9 is a block diagram of the step-listen test setup of the present invention.
Figure 10:
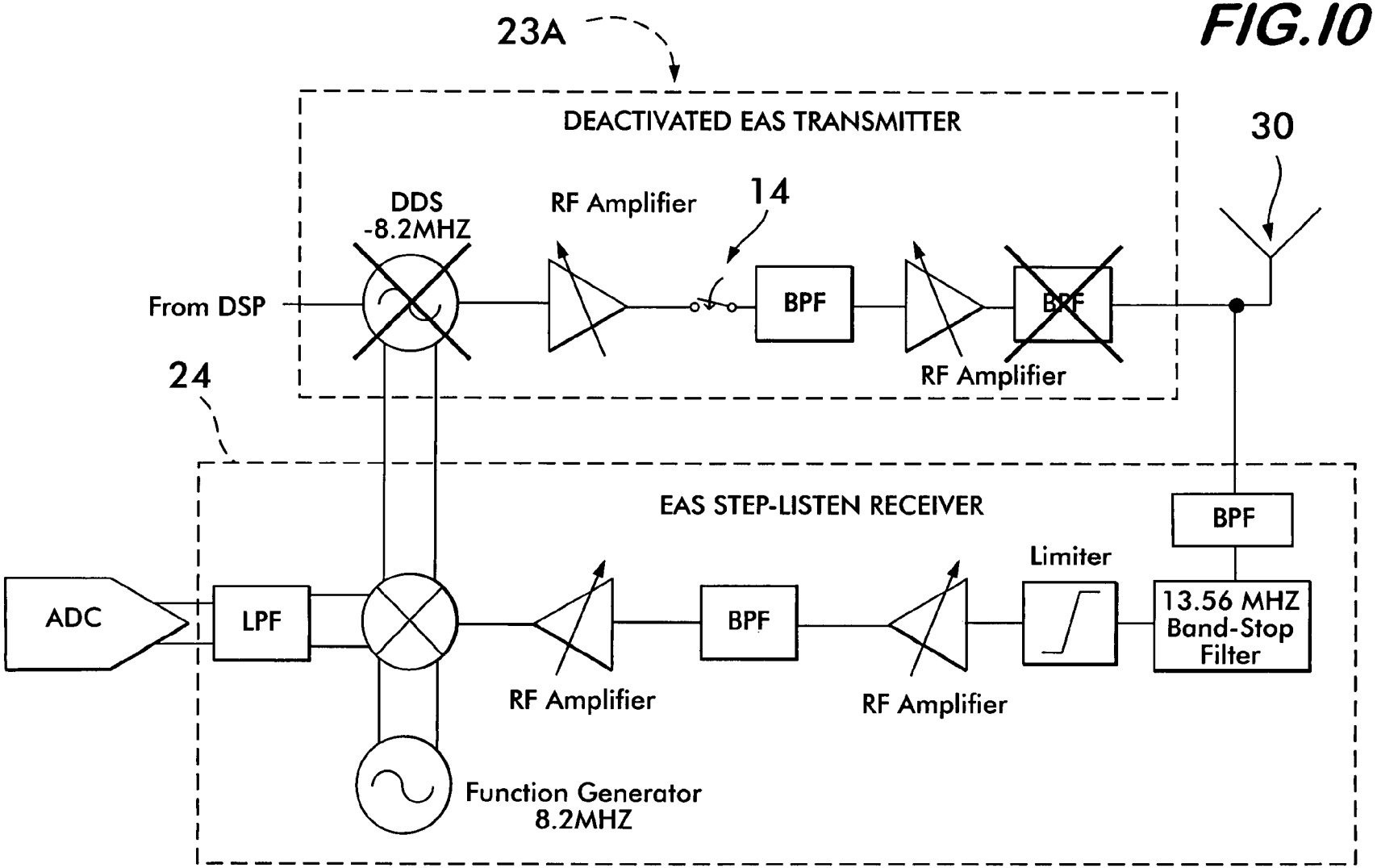
FIG. 10 is a block diagram of the EAS pulse-listen system modified to form the step-listen receiver of the present invention.

(2) a "step-listen" part (FIG. 9) using an ISO15693-compliant RFID reader 22 (e.g., Philips long-range reader) combined with an EAS step-listen receiver 24, e.g., another receiver portion of the TR4024 which is modified to form the EAS step-listen receiver 24, along with a step-listen antenna 30, as shown in FIG. 10; the transmitter portion 23A of the EAS pulse-listen system (or transceiver) 23 was disabled (indicated by the "X" indicia in FIG. 5A) since the RFID reader 22 (e.g., Philips long-range reader) provided the stimulus signal 32. A Checkpoint EAS #410 test tag 12 and Checkpoint RFID #551246 tag 10 were used as the targets.

It should be understood that the Philips reader and the Checkpoint TR4024 pulse-listen system are by way of example only and that the present invention could be implemented using other conventional transceivers and readers.

As mentioned previously, the exemplary EAS pulse-listen system or transceiver 23 is a TR4024 which is the standard electronics module used in the Checkpoint Liberty™ product line. As shown in FIG. 7, the TR4024 basically comprises an EAS transmitter 23A and an EAS receiver 23B that uses digital signal processing (DSP) technology, along with direct digital synthesizing (DDS) technology, to accomplish both the transmit/receive functions. In addition, the TR4024 supports both hardware and software that can be easily modified in order to achieve the testing as will be described in detail later. Furthermore, the TR4024 has the capability to communicate with other Checkpoint products via the Internet.

The first ("conceptual") part of testing consisted of standard EAS pulse-listen electronics (FIG. 7) except that the EAS transmitter 23A was modified (FIG. 8—see EAS transmitter 23A') to transmit at exactly 13.56 MHz., for all transmit bursts. The transmission pattern was otherwise unchanged, i.e., duty cycle, pulse width and pulse times were kept the same. The electronics was then placed in, and connected to a Checkpoint Strata™ PX antenna rig. The system was able to detect a Checkpoint EAS #410 test tag 12. Specifically, the electronics alarmed when the tag 12 was placed at a distance of 12". The test tag 12 was carried parallel to the antenna, along the center axis of the top portion of the 2-loop antenna. The tag-antenna orientation should be considered favorable for detection. The pulse-listen transmission pattern can be considered a form of amplitude shift keying (ASK). Consequently, this type of testing is similar to an ISO15693 interrogator operating at a 100% modulation rate.

In particular, this initial experiment was carried out to verify EAS ring-down, with a 13.56 MHz transmitter. This approach can be considered a reasonable equivalent to step-listen operation at a 100% modulation index (on/off keying). By operating with a full 100% modulation, the system can be classified as a "pulse-listen" system, rather than a "step-listen" system. Shutting off the 13.56 MHz transmitter, using switch 14 (which is normally used in the EAS transmitter 23A for creating the pulse-listen characteristic), as shown in FIG. 8, during the listening period obviates the need for a 13.56 MHz band-stop filter with harsh requirements. This test is a simple first step toward step-listen realization at a more typical modulation index of 10%.

Only a modified EAS pulse-listen system and a Checkpoint Strata PX antenna were required for this experiment. One change to the EAS pulse-listen electronics was necessary; the transmitter chain was broken to allow an externally fed 13.56 MHz signal to drive the power amplifier, and ultimately the antenna. The receiver and detection algorithm were unchanged, i.e., all pulse widths, RX sample times and signal levels were kept as is. A block diagram of the modified EAS pulse-listen transmitter 23A' is shown in FIG. 8.

A Checkpoint EAS #410 test tag was placed within the interrogation zone, in a preferred orientation. The EAS system consistently alarmed when the tag was within 12" of the Checkpoint Strata™ PX antenna.

The various regulatory agencies dictate allowable radiated emissions. There is a significant difference between what is allowed at the typical EAS band and at the 13.56 MHz ISM band. Assume an 8.8× increase in allowable current, when transmitting at 13.56 MHz, given the same antenna geometry. Using the $x^{1/3}$ detection vs. current function, a maximum of 2.1× increase in detection is realized. Based on the earlier results, a maximum detection zone of 25" is predicted per "gate". This estimate does not take into account the side band requirements in the ISM 13.56 MHz band. A more complete discussion of regulatory issues is provided later in the text.

The second ("step-listen") part of testing (FIG. 9) was completed using the EAS step-listen receiver 24 (FIG. 10) and the RFID reader 22. The EAS transmitter 23A was not needed, and therefore disabled. In addition, the EAS step-listen receiver 24 was joined to a small, 3-turn, circular loop antenna 30. This separate, receive-only antenna 30 reduced the amount of 13.56 MHz energy coupled into the step-listen receiver 24, and hence the level of receiver filtering required. The RFID reader 22 was used in the setup to transmit the "step" in step-listen. In addition, this reader 22 continued to provide its intended functionality, namely energize and read ISO15693 RFID tags 10. The typical antenna provided by the reader manufacturer was replaced with a lower Q prototype antenna 28. The lower Q antenna 28 was necessary to provide fast rise and fall times at the modulation edges, as will be discussed in detail later. These sharp edges are required to provide an adequate "step" prior to the "listen". The test results showed that an 8 MHz EAS tag 12 placed within six inches of the antennas 28/30 caused an energy ring-down similar to that seen in a traditional pulse/listen EAS system. Once again, the tag 12 was placed in a favorable position, with respect to both antennas 28/30. The actual oscilloscope traces are shown in FIGS. 11 and 12.

Before the system/method are discussed, a discussion of the step-listen methodology, as well as ISO15693, are provided.

Step-Listen Technology

ISO15693

A standardized RFID protocol, known as ISO15693, specifies a method of RFID reader-to-tag communications. The air-interface specifies reader-to-tag communications using a 13.56 MHz carrier. The commands from the reader to the tag are established by periodically spaced changes (also referred to "modulation edges") in this 13.56 MHz carrier. These changes, or drops, in carrier amplitude form the basis of the "step" in Step-Listen Technology. Thus, step-listen can be considered a byproduct of the RFID ISO15693 standard. However, it should be understood, as will be discussed in detail later, in the present invention 20, these changes or drops need to be "sharp" not rounded and are hereinafter referred to as "falling transition" 32B (see FIGS. 4 and 13). One of the key features of the present invention 20 is that the RFID reader 22 transmitter is modified to provide for such sharp falling transitions 32B in the stimulus signal 32.

This ISO 15693 carrier, with the amplitude changes, can be broken up into two distinct pieces. The first piece is simply a constant-amplitude RF carrier. While the second piece is ON-OFF keying, also at 13.56 MHz, and in-phase with the first piece. This conceptual separation of the ISO signal is possible by the law of superposition. Since an EAS tag will ring-down at its natural frequency, regardless of the stimulus frequency, an 8 MHz exponential decay occurs at the command modulation edges (drops in amplitude), once an EAS tag is brought into the interrogation zone. As a result, the stimulus signal 32 of the present invention 20 can be described as comprising a continuous signal having the following components: a first unmodulated component 32A, the sharp falling transition 32B, the modulated component 32C and a sharp rising transition 32D which is followed by the next unmodulated component 32A.

As can be appreciated, the RFID tag 10 responds to the stimulus signal 32 with the RFID response signal 34 based on the series of the periodically-spaced changes in the 13.56 MHz carrier that the tag 10 receives. In contrast, the EAS tag 12 emits its "ring down" signal 36 each time a falling transition 32A excites the tag 12. Testing has shown that the RFID reader 22 and the EAS step-listen receiver 24 can detect their respective tags within approximately 0.1 seconds of each other.

Modulation Edges and Antenna Q

The ISO15693 standard specifies maximum rise and fall times at the command modulation edges. This maximum limit is easy to implement, yet gives rounded modulation edges. The more rounded these edges are, the more difficult it is to see an EAS ring-down. Consequently, Step-Listen will not necessarily work with any off-the-shelf ISO15693 compliant reader/antenna.

To better understand this, the definition of Q must be discussed. Q is defined as the "quality factor" and is a measure of frequency selectivity or sharpness of the peak of an antenna circuit and is mathematically defined as:

$$Q=f_{cf}\div BW, \tag{1}$$

where $f_{cf}$ is the center frequency or RFID reader transmitter frequency; and BW is the band of frequencies around the center frequency at which the response is no greater than 3 dB down from the center frequency of the RFID reader antenna circuit.

Q is also considered a measure of energy stored vs. energy dissipated at the resonant frequency, or in other words:

$$Q = \omega_0 \cdot \frac{L}{R} \tag{2}$$

where $\omega_0$ is the resonant radian frequency of the antenna circuit and L and R are the inductance and resistance of the antenna circuit. It should be understood that the L and R are by way of example only and that other antenna circuit configurations can be used where Q is also defined in terms of capacitance (C), resistance (R) and/or inductance (L).

There is a linear relationship between the time constant, τ, (defined as the time it takes the response to rise to 63.2% of its final value, or fall to 36.8% of its initial value) and the Q of the antenna circuit using frequency, $f_0$. Specifically, $$\tau = \frac{Q}{\pi \cdot f_0} \tag{3}$$

or $$Q = \tau \cdot \pi \cdot f_0 \tag{4}$$

Choosing a rise/fall time similar to a TR4024 pulse/listen system (τ≈100 ns) thus gives:

Q=4.3

This low value of Q mandates the need for different antenna than the standard antenna supplied with the RFID reader 22, or that specified indirectly by the ISO15693 rise/fall time requirements.

Step-Listen dictates yet another Q requirement. To operate at both EAS and RFID bands, an antenna system needs to adequately transfer energy over a wide frequency spectrum. Specifically, the traditional EAS band is spread from 7.4 MHz. to 8.7 MHz. Thus, the antenna system needs to operate from 7.4 MHz. to above 13.56 MHz.

$$Q=f_{cf}\div BW \tag{1}$$

or

Q=1.1

Rather than lower the Q even further, and waste valuable transmitter power, a separate antenna for EAS reception is preferred. This also lessens the burden of the 13.56 MHz notch filters needed in the EAS step-listen receiver 24.

It should be noted that lowering the Q of an antenna system requires the insertion of series resistors in line with the antenna loop. Increasing the transmitter power can compensate for this loss of transmitter power. This does add cost to the overall product and may negatively impact radiated emissions (radiated emissions are discussed later in the text).

Filter Requirements

To detect the 8 MHz ring down, an EAS receiver needs to filter out the energy coupled from the ISO15693 reader transmitter. This large 13.56 MHz signal will easily blind any receiver, given its large amplitude, relative to the small EAS ring-down signal. Essentially, the stimulus is not desired, but the response is.

The filter required to remove the 13.56 MHz carrier is difficult to implement. The EAS and RFID bands are less than one octave apart. Circuit theory states the closer the filter pass band is to its stop band, the more poles (circuit elements) are necessary to achieve a given amount of attenuation. Due to the inverse relationship between bandwidth and time response, the significant number of poles required will negatively affect the transient response. Specifically, the energy decay of the filter components, during the modulation steps, may mask the EAS tag ring-down. The problem is prevalent throughout pulse-listen systems.

The solution is to use active filters placed at key locations throughout the EAS step-listen receiver 24 path. Multi-feedback bandpass filters (MFBP) reduce the transient response, but maintain the frequency response characteristics. By using active filters, the need for inductors is also reduced, if not eliminated.

Active filters require operational amplifiers. Since op-amps are priced significantly higher than inductors, cost are added to the electronics. Op-amps also contribute broadband noise to any system. By virtue of this filter/feedback implementation, this added noise is in the passband. Thus, the lowest noise op-amps should be used (~pA/$\sqrt{Hz}$). A very fast slew-rate is also required (>500 V/us).

A compromise is to use several series resonant circuits attached to the inputs of the MFBP filters and circuit ground. This reduces the burden of the active portion of the filtering, but lengthens the transient response. In general, inductors have wide tolerances, necessitating the need for tunable inductors and/or capacitors.

Finally, the best way to reduce the filter requirements is to use a separate antenna for receiving EAS signals. Coupling between the RFID antenna and the EAS receive-only antenna can be minimized without affecting the system's detection range.

What EAS Frequency?

The worldwide regulatory agencies confine EAS operation to a specific frequency band. These restrictions apply to the system's transmitter, but not the passive EAS tag. The tag can be resonant at any frequency we desire.

In choosing a frequency(s), there are some performance related issues to consider. The closer the excitation frequency (transmitter) is to the tag's natural resonant frequency, the more energy will be stored by the tag. The system's detection range is a direct result of the tag's energy storage. This physical law suggests that the tag's resonant frequency be at or near 13.56 MHz, the only excitation source in step-listen operation.

There are some tradeoffs however. Using an EAS tag with a resonant frequency at/near 13.56 MHz results in maximum energy storage and require no special filtering, a perceived benefit. The difficulty, however, is in the detection of the EAS tag's exponential decay. The EAS ring-down is masked by the RFID reader transmitter, which by virtue of ISO15693, is continuously on. Step-Listen suggests looking for the presence of an EAS tag during the RFID command modulation steps, or amplitude transitions. Observing a minute discharge of energy from the tag, at this transition time is difficult even when the excitation and resonant frequencies are far apart. Making the frequencies the same further compounds the problem.

Using an EAS tag with a resonant frequency significantly different than 13.56 MHz. results in much lower energy storage. This approach does have one important benefit, however. Greatly separating the EAS and RFID frequencies, eases the filter requirements. This benefit aside, the conclusion is that trading tag signal for easier filter specifications is not a worthwhile compromise. Employing an EAS tag with a lower resonant frequency is not a good solution.

The existing EAS frequency band (7.4 MHz. to 8.7 MHz.) is the best choice for step-listen operation. The tag can store a satisfactory amount of energy from the 13.56 MHz. stimulus. Yet, the ring-down frequency is far enough away from 13.56 MHz. to be detected. The EAS filter requirements are strict, yet realizable.

Use of the present EAS tags have other benefits as well. Much knowledge of tag-system interaction has been gained after years of EAS electronics development. Existing electronic circuits and algorithms can be migrated over to the step-listen system. In fact, as mentioned earlier, a modified EAS receiver was used during both the conceptual and step-listen parts.

Step-Listen Testing Details

There are three key hardware elements used in this experiment: a Philips SLRM900 I code reader (for the RFID reader 22), a modified TR4024 (for the EAS step-listen receiver 24) and an antenna pair (28, for the RFID reader 22 and 30 for the EAS step-listen receiver 24). Additional lab equipment used included a dual power supply, laptop computer, function generator and oscilloscope. A block diagram is shown in FIG. 9.

Philips RFID Reader

The Philips SL RM900 I*code Long Range Reader module is provided to users as part of the overall SL EV900 Evaluation Kit. Also included in the kit is a rectangular loop antenna & matching network, demo software and a selection of I code RFID tags.

The supplied antenna has a Q of about 27. As mentioned in the preceding paragraphs, this high quality factor causes the modulation edges to be more rounded than required for step-listen detection. The replacement antenna and matching network are discussed later in the text.

The demo software issued with the kit is the I code Demo v3.03. A laptop computer was necessary for initial configuration and operation.

I code I tags were used to continually verify RFID performance throughout the step-listen experiments.

The reader 22 itself was configured for a modulation index of 10% and an output power of 3.75 watts; the Philips SL RM900 I*code Long Range Reader has an adjustable output power range of 0–4 watts but for purposes of the testing, the output power was held at 3.75 watts and thus the settings were not changed throughout the experiments. The system was operated in the "Read Serial Numbers" mode. Also, the reader hardware was unmodified, all though several digital signals were used to synchronize the TR4024 pulse-listen receiver, in a non-intrusive manner.

TR4024 Modifications

Since the energy source for step-listen is from the RFID reader 22, the TR4024 transmitter 23A was not needed and therefore was disabled shown in FIG. 10. It should be noted that simply setting the TR4024 transmitter levels to zero was not enough to disable the transmitter 23A. This simply sets the power FET DC rails to 0 VDC. There was still some bleed thru, from the FET gates, passed out to the antenna 30. This caused some misleading results early on in the experiments. In addition, a parallel capacitor/inductor combination (C112/L10, not shown) were removed to prevent any EAS ring-down from traveling back through the disabled transmitter 23A.

Most of the modifications to the TR4024 were to its receiver circuit. The primary reason for this was to filter out the 13.56 MHz stimulus signal 32 from the RFID reader 22. In addition, receiver on/off gating, normally controlled by a FPGA (field programmable gate array) in the TR4024, was done using the command modulation pulse, from the RFID reader 22.

Filters were placed at several locations through the receiver path. Starting from the antenna port, a 13.56 MHz parallel resonant circuit was created at L3 (not shown) by adding shunt capacitors. Since only one of the multiple receiver inputs is needed, a jumper was placed at K6-A (not shown), input-to-output. A filter board was added in place of C192 (not shown). This filter board comprises a low pass filter with a 13.56 MHz notch. To accomplish the receiver gating function, R79 (not shown) was removed and replaced with a jumper from the RFID reader. This gating signal is the command modulation. Essentially, the falling edge from the modulation signal, the "step", enables the mixer/demodulator U17. A rising edge disables this chip.

A PDA assisted service system (PASS) configuration was set to maximum receiver gain and zero transmitter output. Since only the receiver's analog section was needed, all other palm settings are irrelevant.

To facilitate the EAS detection, the local oscillator was set to a fixed frequency. This set frequency was very close to the resonant frequency of the EAS tag 12. This allows the baseband ring-down to be more easily seen on an oscilloscope 13 (FIG. 9). This is a favorable condition for the receiver, and is not possible when using a wide variety of EAS tags. The signal was supplied from an external signal generator (e.g., function generator) connected to TP7 (not shown) in the TR4024. R41 (not shown) was removed to prevent coupling from the on-board local oscillator (U8, not shown).

The EAS step-listen receiver 24 needs to know when to "listen" for the tag ring-down. To accomplish this, the command modulation signal from the RFID reader 22 is used. The signal is connected to an AGC (automatic gain control) pin of the TR4024 mixer/demodulator U17 (not shown). This connection method is non-intrusive, so no buffer is needed. An inverted version of this signal is used to gate the external signal generator (e.g., function generator), also referred to as "external LO". This keeps the phase relationship between the command modulation and the local oscillator consistent, at each "step". Either of these signals was used to trigger the oscilloscope 13.

Low Q RFID Antenna & Receive-Only EAS Antenna Pair

The required Q of the antenna is directly related to the necessary signals being passed though it. It is necessary that the RFID reader transmitter provide a stimulus signal 32 that has sharp modulation edges. Step-Listen relies on a sufficient "step" at these edges. As mentioned earlier, the Q of the supplied antenna with the RFID reader 22 is about 27. This gives a BW of only 502 KHz, which results in a minimum rise time, $t_r$ (the time it takes the signal to transition from 10% to 90% of its final value) of any signal to be:

$$t_r = \frac{1}{\pi \cdot f_0} \tag{5}$$

$$t_r = 0.6 \text{ us}$$

Step-Listen cannot be proven with this antenna.

A new antenna and antenna circuit was necessary. FIG. 14 depicts one preferred embodiment of this new antenna/antenna circuit. In creating the proper matching network 38 for the RFID reader antenna 28 using "de-Q-ing" resistors 40, the inductance (L) and resistance (R) were measured at the center frequency ($f_{cf}$) of 13.56 MHz and then Q was calculated using equation (2). Once the matching network was connected to the antenna 28 and de-Q-ing resistors, the frequency response of the resultant circuit was measured. From the peak resonance at/near 13.56 MHz, the response decreased as the frequency of the stimulus signal 32 was varied away from 13.56 MHz, in either direction. The frequencies at which the response is 3 dB less than peak is the bandwidth (BW) of the circuit. Using equation (1), the Q was calculated and compared to that obtained using equation (2) and the results of these two calculations were close.

The rise time of the TR4024 transmitter is on the order of 100 ns. Plugging this into equation (2) results in an antenna Q of 4.26. The concern was that with such a low Q antenna, the detection range of the RFID system would suffer. A compromise Q of 6.4 was actually used in the experiments.—The Q value was arrived at by adding available de-Q-ing resistors (1%) in series, which lower the Q value of the antenna circuit, to as close to 4.26 as possible. The result was the presence of the sharp falling edges in the stimulus signal 32. It should be understood that a range of Q values could be used, e.g., 6–7, wherein the maximum Q value is limited by the need to maintain the sharp modulation edge whereas the minimum Q value is limited by the RFID reader's ability to handle in-band noise because the lower the Q, the larger the bandwidth and in-band noise.

The new antenna 28 has a measured Q of about 6.4. This calculates out to a rise time of 150 ns, close to the target of 100 ns. The waveform measured at the lower Q antenna is shown in FIG. 13.

As mentioned previously, the lower Q was accomplished simply by adding de-Q-ing resistors in series to each side of the inductive loop. The added R, and the fact that the L of the new loop was larger, necessitated a new impedance transformation network. The same topology was used in the new match. Specifically, a differential L-type network 38 (FIG. 14), transforming the antenna impedance to 200 ohms (real only, i.e., resistive) was incorporated. A balun 42 (preferably, Ruthroff balun) converted this 200-ohm differential impedance to a single-ended 50-ohm load (also real only), capable of being driven by the 50-ohm transmitter via a coax cable (not shown). A schematic of the new antenna/match network is shown in FIG. 14.

The balun 42 is standard use in RF transmission because it provides the interface from an unbalanced transmission network (incoming wireless signal) to a balanced system (the RF demodulator), and hence the name "BALanced-Unbalanced. In particular, the antenna structure is a wire loop antenna (balanced) whereas the RFID reader 22 output requires a single-ended termination, referenced to ground (unbalanced). The Ruthroff balun utilizes 10 turns unbalanced to 20 turns balanced. In general, an L-type network transforms some impedance (real and reactive) to some other impedance (e.g., real only). In particular, the output of the RFID reader 22 wants to see a 50-ohm impedance (real only). The balun transforms the impedance from 50 ohm unbalanced to 200 ohm balanced the L-type network 38.

A separate receive antenna was used, for "listening" to the EAS tag ring-down. The purpose of the separate antenna was to reduce the 13.56 MHz energy coupled into the EAS receiver. Just as a reminder, the EAS tag ring-down is at the natural resonant frequency of the tag, or nominally 8.2 MHz. The ability to see this small signal, in the presence of the much larger 13.56 MHz RFID signal is key to Step-Listen operation. Reducing the RFID energy coupled into the EAS receiver, by using separate antennas, lessens the burden of the receiver filters.

The new antenna 30 was a 5-turn loop, with a 5" diameter. The number of turns was chosen so the resultant antenna impedance was similar to what the TR4024 would normally see with the Checkpoint Liberty™ PX 2-loop.

In effecting the sharp falling transition 32B, modulation of the carrier frequency of 13.56 MHz works better than use of higher carrier frequencies. As can be seen most clearly in FIG. 15, when the modulation occurs, the carrier amplitude is attenuated within a single cycle of the 13.56 MHz signal, thereby allowing for a sharp slope between the unmodulated component 32A and the modulated component 32C. In contrast, a higher carrier frequency, (e.g., 20 MHz) requires a few cycles of intermediate amplitude before the modulated component 32C' is achieved (from the unmodulated component 32A'); in that case, a less sharp and more rounded (and less desirable) falling transition 32B' occurs. FIG. 16 depicts the quicker power fall-off (when modulation occurs) using the modified RFID reader 22 of the present invention 20 as compared to conventional RFID readers.

Regulatory-European Radiated Emissions

The EAS label stores less energy when stimulated at 13.56 MHz. This is compared to a typical EAS stimulus of 7.4–8.7 MHz. However, some of this can be overcome by using a larger stimulus, the maximum which is limited by the regulatory agencies. The following paragraphs attempt to quantify the increase in antenna current allowed when using a 13.56 MHz energy source.

There are significant differences between the magnetic fields allowed at the 8 MHz EAS band and that allowed at the 13.56 MHz ISM band. This ISM band is unlicensed, and consequentially a much greater field is permitted. Because of the different frequencies and pulsing patterns involved, a direct comparison of the limits is not applicable. However, by combining test data and a basic magnetic field formula we can arrive at a result. It is assumed that the same antenna is used for the comparison.

The specifications state that for the EAS band, 51 dBuV/m is allowed, at 30 m. The detector used is a quasi-peak type. At the RFID ISM band, the limit is 84 dBuV/m, at 30 m. This detector is also a quasi-peak type.

A quasi-peak detector is a measure of the "nuisance factor" of a particular signal. This detector takes into account the signal's duty cycle and pulse repetition frequency (PRF). The lower the PRF, the lower the quasi-peak measurement will be, as compared to a peak measurement. For a CW signal, there is no difference between a quasi-peak measurement and a peak measurement. The typical Checkpoint Strata™ transmission pattern shows a 5.4-db difference between peak and quasi-peak measurements.

Additionally, frequency effects need to be considered. A far-field magnetic field formula used is:

$$H_\theta = \frac{-\pi^2 \cdot a^2 \cdot I \cdot e^{-j \cdot k \cdot r} \cdot \sin\theta}{\lambda^2} \tag{6}$$

where $H_\theta$ is the magnetic field intensity and $\lambda$ is the wavelength (e.g., 22.1 m). Considering the wavelength dependence in the denominator, there is an 8.7 dB increase in magnetic field when using the 13.56 MHz band, compared to 8.2 MHz. Table 1 calculates the increase in current allowed.

TABLE 1

Comparison of the European Radiated Emissions levels, 8.2 MHz. vs. 13.56 MHz.

| Band | Quasi-peak limit @30 m | Peak limit conversion |
|---|---|---|
| 8.2 MHz. EAS Band | 51 dBuV/m | 56.4 dBuV/m |
| 13.56 MHz. ISM Band | 84 dBuV/m | 84 dBuV/m |
| | gain | 27.6 dB |
| | Freq. effects | −8.7 dB |
| | Net | 18.9 dB |

In summary, transmitter current can be increased by 18.9 dB, or 8.8×.

The discussion so far has only focused on the 13.56 MHz carrier. Strict limits exist for the so-called side bands, or energy emitted at frequencies other than 13.56 MHz. ±7 kHz. Specifically, the limits drop by 33.5 dB for energy outside the ±7 kHz bandwidth. At 150 kHz away from the carrier, the limit drops an additional 10 dB. These side-band restrictions must be considered when increasing transmitter current or using a lower Q antenna for sharp modulation edges. So far, the experiments have shown no detectable increase in side bands, when using the lower Q antenna.

Obstacles

A lower Q antenna permits more, broader band noise into the RFID receiver. It was assumed that the small drop in RFID detection was due to the lower antenna current from the transmitter, and not broadband noise into the receiver. Exact RFID performance degradation is not known. What percentage of the performance drop is due to added receiver noise is not known.

The lower Q antenna will also waste energy. The drop in antenna current can be calculated using the following:

$$\Delta I = \sqrt{\frac{Q_2}{Q_1}} \tag{7}$$

$$\Delta I = \sqrt{\frac{6.4}{27}} = 0.49$$

Figure 17:
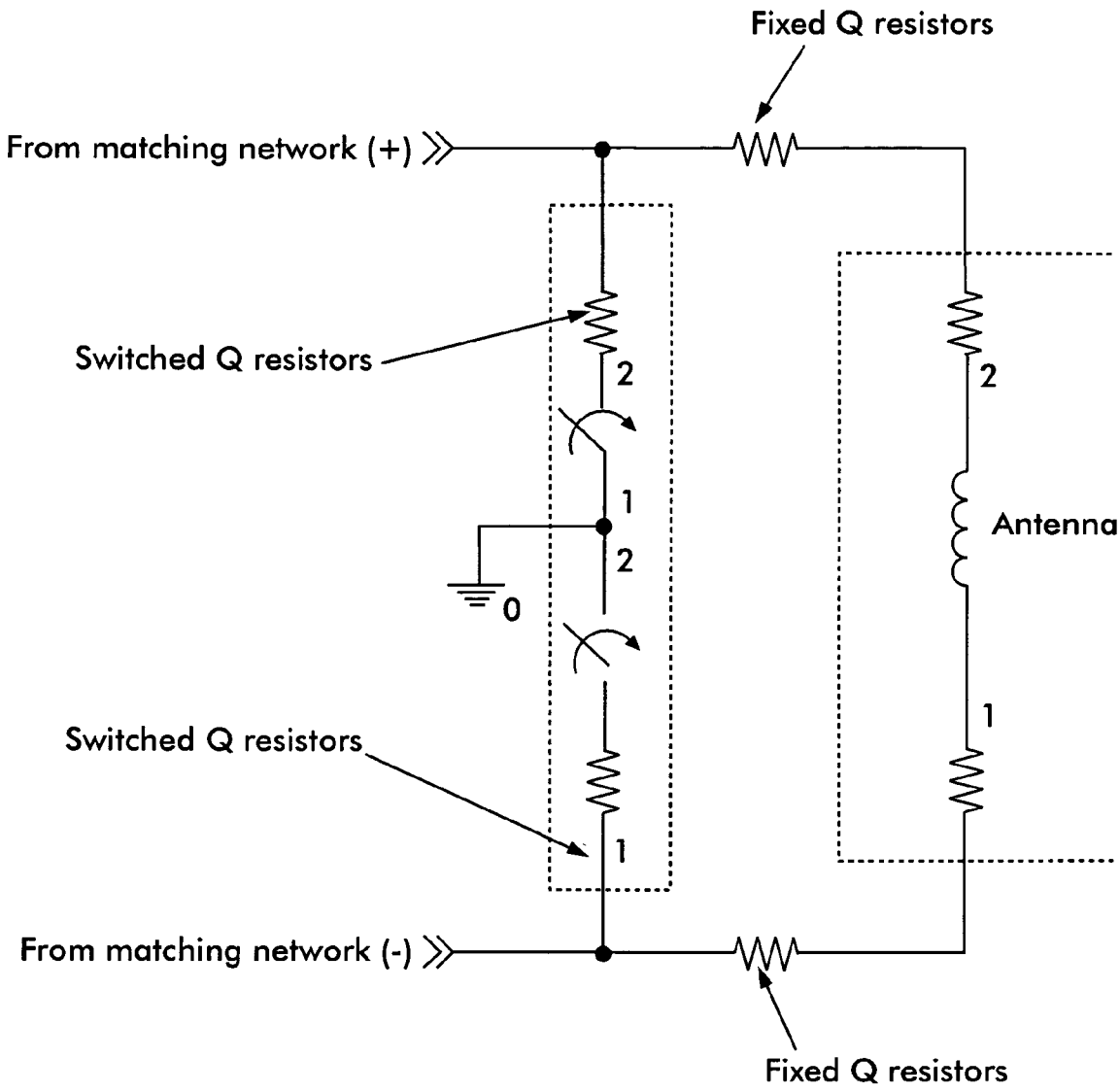
FIG. 17 is a schematic depicting an alternative antenna circuit, a switched Q antenna circuit, for the RFID reader.

Some of this wasted energy can be made up by actively switching Q resistors. Effectively changing the resistors values in parallel with the antenna can change the amplitude, and Q. This results in a fixed antenna (and Q) for amplitudes of 100%. At the time of modulation, additional resistors can be switched in to drop the amplitude 18%, per the ISO15693 specification. The added resistors lower the Q of the antenna and, more importantly, give the sharp modulation edges desired for step-listen operation. It should be noted that any resistance in series with the antenna could be converted into a parallel equivalent resistance. It is this parallel equivalent resistance that can be changed at the modulation time. A schematic of this concept is shown in FIG. 17. Finally, a class D amplifier may be used as the transmitter, further reducing the "wasted" energy.

As mentioned earlier, a low pass filter with a 13.56 MHz notch was used in the modified TR4024. Attenuation at 13.56 MHz. was measured at approximately 20 dB. No insertion loss was observed.

Performance improvements can be realized with better filters. For example, active filters can be placed at several stages throughout the receiver. Multi-feedback bandpass filters (MFBP), with low-noise high-speed operational amplifiers, should be incorporated. It can be shown that 100 dB of attenuation is needed when the EAS and RFID systems are using the same antenna. With separate antennas, the amount of filtering needed is less. Exactly what is needed depends on the coupling coefficient between the two antennas. As with all pulse-listen systems, the transient response of any filter is crucial for a time-domain based receiver architecture.

The overall success of the step-listen depends on the EAS receiver filters. Its ability to remove the 13.56 MHz carrier directly affects EAS detection distance. Once an antenna configuration is determined, and the coupling coefficient determined, the exact filter requirements can be calculated. With this information, the correlation between filter performance and EAS detection distance can be established. Active filter implementation is strongly recommended.

As mentioned earlier, antenna Q is very important. The RFID reader-tag system requires a relatively high Q transmitter/antenna to energize the tag. Conversely, EAS reception depends on a low Q system, by virtue of the frequency separation of the EAS and RFID bands. An active Q-switching antenna helps with both issues.

It should be understood that although the preferred embodiment has the EAS receiver listening when the modulation transition is a "falling transition" 32B (where there is less of a "13.56 MHz signal than compared to a "rising transition"), it is within the broadest scope of the present invention 20 to include a detection of the EAS tag's natural response due to the rising transition 32D. Preferably, this rising transition 32D is also sharp for the same reasons discussed previously with respect to the falling transition 32B.

It should also be noted that testing has shown that the EAS step-listen receiver 24 and the RFID reader 22 can detect their respective tags within approximately 0.1 seconds of each other. Because the step-listen operation is the simultaneous operation of both RFID and EAS, there is no loss of performance in RFID operation. To the system user, this appears as real time functionality. Moreover, because only a single transmitter (e.g., RFID reader 22) is used for both RFID and EAS functionality, this results in cost savings and reduced packaging size. In contrast, where others attempt to couple RFID with EAS systems, respective transmitters are used with a shared or separate antennae. To avoid RF interference, these systems must be operated sequentially, in a time division multiplex format. Essentially, such a configuration has only one system, RFID or EAS, operating at anyone time, while the other system waits. The result is performance degradation to both systems, and less than real time functionality.

While the invention has been described in detail and with reference to specific examples thereof, it will be apparent to one skilled in the art that various changes and modifications can be made therein without departing from the spirit and scope thereof.

What is claimed is:

1. A system for detecting a first signal from an electronic article surveillance (EAS) resonant circuit tag that is tuned to a frequency in an EAS frequency band and a second signal from a radio frequency identification (RFID) tag that is tuned to a frequency in an RFID frequency band, said system comprising:

a transmitter for emitting said transmit signal, said transmit signal comprising a carrier signal of a frequency in said RFID frequency band and that is amplitude modulated for sending commands to the RFID tag, said transmit signal comprising modulation edges that cause said EAS tag to emit said first signal when said transmit signal impinges on said EAS resonant circuit tag;

a first receiver, tuned to a frequency in said EAS frequency band, for receiving said first signal, said first signal comprising the natural response of said EAS resonant circuit; and a second receiver, tuned to a frequency in said RFID frequency band, for receiving said second signal.

2. The system of claim 1 wherein said transmitter and said second receiver comprise an RFID reader.

3. The system of claim 2 wherein said transmitter and said second receiver share a second antenna for transmitting said transmit signal and for receiving said second signal.

4. The system of claim 3 wherein said first receiver comprises a first antenna different from said second antenna.

5. The system of claim 4 wherein said first antenna comprises a plurality of loops.

6. The system of claim 5 wherein said plurality of loops comprises five loops.

7. The system of claim 4 wherein said transmitter, said first receiver and said second receiver are contained within a single housing.

8. The system of claim 7 wherein said single housing is contained within one pedestal of a pair of pedestals at the entrance of a business.

9. The system of claim 4 wherein said transmitter, said first receiver and said second receiver are contained within one pedestal of a pair of pedestals at the entrance of a business.

10. The system of claim 3 wherein said EAS frequency band comprises the range of frequencies 7.4 MHz to 8.7 MHz.

11. The system of claim 10 wherein said frequency in said EAS frequency band is approximately 8.2 MHz.

12. The system of claim 3 wherein said frequency in said RFID frequency band is 13.56 MHz.

13. The system of claim 2 wherein said first receiver also uses said second antenna for receiving said first signal.

14. The system of claim 13 wherein said common antenna comprises a Q of approximately 6.4.

15. The system of claim 14 wherein said common antenna comprises a differential L-type network.

16. The system of claim 15 wherein said common antenna further comprises a balun for converting the differential impedance into a single-ended load.

17. The system of claim 14 wherein said antenna comprises a switched Q circuit.

18. The system of claim 13 wherein said first receiver comprises a receiver path and wherein said receiver path comprises at least one active filter to filter out said transmit signal.

19. The system of claim 13 wherein said first receiver comprises a receiver path and wherein said receiver path comprises series resonant circuits to filter out said transmit signal.

20. The system of claim 1 wherein said transmitter is configured for a modulation index of approximately 10%.

21. The system of claim 1 wherein the output power of said transmitter is 3.75 watts.

22. The system of claim 1 wherein said modulation edge comprises a falling modulation edge.

23. The system of claim 22 wherein said transmit signal further comprises a first unmodulated component, said falling modulation edge component, a modulated component, a rising modulation edge component and a second unmodulated component.

24. The system of claim 23 wherein said transmit signal comprises a frequency of 13.56 MHz.

25. The system of claim 24 wherein said falling modulation edge comprises a sharp decrease in the amplitude between said first unmodulated component and said modulated component.

26. The system of claim 24 wherein said rising modulation edge comprises a sharp increase in the amplitude between said modulated component and said second unmodulated component.

27. The system of claim 24 wherein said transmitter is configured for a modulation index of approximately 10%.

28. A method for concurrently detecting a first signal from an electronic article surveillance (EAS) resonant circuit tag that is tuned to a frequency in an EAS frequency band and a second signal from a radio frequency identification (RFID) tag that is tuned to a frequency in an RFID frequency band, said method comprising the steps of:

(a) amplitude modulating a carrier signal having a frequency in said RFID frequency band to form said transmit signal, said transmit signal comprising modulation edges;

(b) emitting said transmit signal to impinge on said EAS resonant circuit tag and on said RFID tag;

(c) emitting said first signal by said EAS resonant circuit tag in response to said modulation edges of said transmit signal, said first signal comprising the natural response of said resonant circuit in said EAS resonant circuit tag;

(d) emitting said second signal by said RFID tag in response to said transmit signal; and (e) detecting said first and second signals.

29. The method of claim 28 wherein said step of detecting said first and second signals comprises using respective antennae to receive said first and second signals.

30. The method of claim 29 wherein said step of detecting said first and second signals comprises actively filtering said received first signal by said respective antenna.

31. The method of claim 30 wherein said step of detecting said first and second signals comprises switching Q resistors in said respective antenna.

32. The method of claim 28 wherein said EAS frequency band comprises the range of frequencies 7.4 MHz to 8.7 MHz.

33. The method of claim 32 wherein said frequency in said EAS frequency band is approximately 8.2 MHz.

34. The method of claim 28 wherein said frequency in said RFID frequency band is 13.56 MHz.

35. The method of claim 28 wherein said step of amplitude modulating said carrier signal comprises implementing a modulation index of approximately 10%.

36. The method of claim 28 wherein said step of emitting said transmit signal comprises emitting said transmit signal with an output power of approximately 3.75 watts.

37. The method of claim 28 wherein said step of amplitude modulating a carrier signal comprises providing a continuous carrier signal that is unmodulated;

amplitude modulating said continuous carrier signal to form an amplitude modulated carrier signal and wherein a sharp decrease in amplitude is generated when said amplitude modulation begins and forming one of said modulation edges; and deactivating said amplitude modulation to generate said unmodulated carrier signal and wherein another modulation edge is formed when said deactivation occurs.

38. The method of claim 37 wherein said step of deactivating said amplitude modulation further comprises creating a sharp increase in amplitude to form said another modulation edge.

39. The method of claim 37 wherein said continuous carrier signal comprises a 13.56 MHz signal.

40. The method of claim 39 wherein said amplitude modulation comprises a modulation index of approximately 10%.

41. A method for concurrently detecting a first signal from an electronic article surveillance (EAS) resonant circuit tag that is tuned to a frequency in an EAS frequency band and a second signal from a radio frequency identification (RFID) tag that is tuned to a frequency in an RFID frequency band, said method comprising the steps of:

(a) generating a transmit signal having the following characteristics: a first oscillating signal component having a first amplitude, a second oscillating signal component having a second amplitude less than said first amplitude and wherein there is a sharp decrease between said first amplitude and said second amplitude and a third oscillating signal component having said first amplitude and wherein there is a sharp increase between said second amplitude and said first amplitude of said third oscillating signal;

(b) emitting said transmit signal to impinge on said EAS resonant circuit tag and on said RFID tag;

(c) emitting said first signal by said EAS resonant circuit tag in response to said sharp decrease of said transmit signal, said first signal comprising the natural response of said resonant circuit in said EAS resonant circuit tag;

(d) emitting said second signal by said RFID tag in response to said transmit signal; and (e) detecting said first and second signals.

42. The method of claim 41 wherein said first oscillating signal, said second oscillating signal and said third oscillating signal comprise a frequency of 13.56 MHz.

43. The system of claim 42 wherein said transmitter is configured for a modulation index of approximately 10%.

* * * * *